US006102311A

United States Patent [19]

Fujikawa

[11] Patent Number: 6,102,311

[45] Date of Patent: Aug. 15, 2000

[54] WORKING METHOD OF CRUSHING AND SEPARATING WASTE SUBSTANCE OF WEATHER STRIP AND APPARATUS THEREFOR

[75] Inventor: Masakazu Fujikawa, Kariya, Japan

[73] Assignee: Fujikawa Kinzoku Co., Ltd., Japan

[21] Appl. No.: 09/357,216

[22] Filed: Jul. 20, 1999

[51] Int. Cl.[7] ..... B02C 13/02; B02C 13/282; B02C 19/12

[52] U.S. Cl. ..... 241/24.13; 241/24.17; 241/27; 241/73; 241/189.1; 241/285.3; 241/DIG. 31

[58] Field of Search ..... 241/24.13, 24.14, 241/24.17, 24.18, 27, 79.1, 189.1, DIG. 38, DIG. 31, 73, 285.3

[56] References Cited

U.S. PATENT DOCUMENTS

| | | | |
|---|---|---|---|
| 2,136,099 | 11/1938 | Buxbaum | 241/24.17 X |
| 2,962,233 | 11/1960 | Chryst, Jr. et al. . | |
| 3,384,309 | 5/1968 | Marshall | 241/24.17 X |
| 5,938,128 | 8/1999 | Engel et al. | 241/1 |

FOREIGN PATENT DOCUMENTS

| | | |
|---|---|---|
| 57-42509 | 9/1982 | Japan . |
| 63-315155 | 12/1988 | Japan . |
| 5-7796 | 1/1993 | Japan . |
| 6-198205 | 7/1994 | Japan . |
| 6-226123 | 8/1994 | Japan . |
| 7-256129 | 10/1995 | Japan . |
| 11-207312 | 8/1999 | Japan . |
| WO 97/39828 | 10/1997 | WIPO . |

OTHER PUBLICATIONS

English Abstract of JP 04165129, (Jul. 19, 1994).

European Search Report dated Sep. 29, 1999 at The Hague by J. Verdonck.

*Primary Examiner*—John M. Husar

*Attorney, Agent, or Firm*—Finnegan, Henderson, Farabow, Garrett & Dunner, L.L.P.

[57] ABSTRACT

A waste substance is crushed and separated into a crushed waste metallic substance and a crushed waste non-metallic substance by the crushing in the fine adjustment in mm unit and striking by hammers, and then discharged out of a shredder through box-shaped spaces having an inclined plane of an inclined upper shredder damper rocking by the fine adjustment in mm unit of the shredder. Thereby the waste substance is crushed and separated securely and efficiently, and the crushed waste metallic substance in 2–5 mm unit and the crushed waste non-metallic substance can be manufactured in the state that they are valuable as articles of commerce and can be effectively utilized as resources. When the crushed waste metallic substance is supplied to a furnace, the melting speed can be improved and the fuel cost necessary for the melting can be saved. Also the invention contributes to prevention of abuses such as environmental pollution by soot and smoke and the contamination of the atmosphere.

2 Claims, 11 Drawing Sheets

WORKING METHOD OF CRUSHING AND SEPARATING WASTE SUBSTANCE OF WEATHER STRIP AND APPARATUS THEREFOR

BACKGROUND OF THE INVENTION (1) Field of the Invention

The present invention relates to a flexible weather strip (various yielding substances for waterproofing, vibration absorbing or the like) constituted by a thin flexible metal member in small flat U-like shape having a cut groove and a rubber member covering the metal member, and relates to a working method of crushing and separating a waste substance of the flexible weather strip (hereinafter referred to as "waste substance of weather strip") and an apparatus therefor.

(2) Description of the Prior Art

In the prior art, as a method of treating a waste substance of a weather strip (hereinafter referred to simply as "waste substance"), there is a method that a waste substance is thrown away remaining intact or burned up or buried, and such a method is taken in the present state. In some case, a waste substance is subjected to a crushing and separating treatment utilizing a usual shredder for crushing a metal member. However, sufficient measure is not taken in the present state.

References in the prior art are shown in following references ①–⑤.

① JP-A 6-198205

A shredder crushing a braid for an automobile is constituted by a shredder drum having a number of hammers, a shredder damper with box-shaped through holes, an intermediate wall confronting the shredder drum, and a cylinder operating the shredder damper in 5 mm unit. A waste substance of a braid is led to a shredder through a supply device, and is crushed and separated by the shredder into metallic crushed small pieces and non-metallic crushed small pieces.

② JP-Y 57-42509

A crushing machine is constructed so that a scrap is crushed by a crushing blade and hammers provided in a casing and the crushed substances are allowed to collide against the first exit door of the casing, and an object of the crushing machine is to treat prescribed crushed dimension and many sorts of the crushed substances.

③ JP-A 63-315155

A crushing machine is constructed so that a scrap is crushed by a rotor and a crushing blade provided on an exit plate and the crushed substances are selected and transferred utilizing the casing and the first to fourth dampers, and an object of the crushing machine is to treat prescribed crushed dimension and many sorts of the crushed substances utilizing the collision against the second and fourth dampers.

④ JP-A 6-226123

A hammer crusher is constructed in that the hammer crusher has a grate with a gap, and a rotor with hammers in teeth shape is installed in a crushing chamber of the hammer crusher. The hammer crusher is characterized in that a substance to be crushed is crushed while it is twisted between the hammers and a collision member comprising stepped Portions in the crushing chamber, and the crushed substances are discharged out of the crusher through the gap of the grate.

⑤ JP-A 7-256129

A volume reducing apparatus with air separation mechanism is constructed in that the volume reducing apparatus has an adjusting plate with a gap, and a rotor with hammers in teeth shape is installed in a crushing chamber of the volume reducing apparatus. The volume reducing apparatus with air separation mechanism is characterized in that a substance to be crushed is crushed between the hammers and a collision member comprising stepped portions in the crushing chamber, and the crushed substances are separated in the specific gravity by the air separation mechanism and the collected metal substances are discharged out of the volume reducing apparatus through the gap of the adjusting plate and the substances with light weight are discharged out of the volume reducing apparatus through a suction duct.

The invention in the reference ① is characterized in that a waste substance of a braid is crushed and separated by a shredder damper moving in 5 mm unit or an intermediate wall and hammers into metallic crushed small pieces and non-metallic crushed small pieces. Accordingly this invention is suitable in crushing and separating a waste substance of a braid, but seems to be not suitable in crushing and separating a waste substance of a weather strip relatively smaller than that of the braid.

The invention in the reference ② is constructed in that a scrap is crushed by a crushing blade and hammers provided in a casing. Accordingly this invention is suitable in crushing and separating a usual scrap securely, but seems to be not suitable in crushing and separating a waste substance of a weather strip relatively smaller than that of the scrap.

The invention in the reference ③ is constructed in that a scrap is crushed by a rotor and a crushing blade provided on an exit plate. Accordingly this invention is suitable in crushing and separating usual scraps securely, but seems to be not suitable in crushing and separating a waste substance of a weather strip relatively smaller than that of the scrap.

The invention in the reference ④ is constructed in that a substance to be crushed is crushed while it is twisted between hammers in teeth shape installed in a crushing chamber and a collision member comprising stepped portions in the crushing chamber. Accordingly this invention is suitable in crushing and separating scraps of a refrigerator, a washing machine or the like securely, but seems to be not suitable in crushing and separating a waste substance of a weather strip relatively smaller than that of the scrap.

The invention in the reference ⑤ is constructed in that a substance to be crushed is crushed between hammers and a collision member comprising stepped portions in a crushing chamber, and the crushed substances are separated in the specific gravity by air separation mechanism into collected metal substances and substances with light weight. Accordingly this invention is suitable in crushing and separating large scraps of a domestic electric product, a refrigerator, a washing machine or the like securely, but seems to be not suitable in crushing and separating a waste substance of a weather strip relatively smaller than that of the scrap.

SUMMARY OF THE INVENTION

An object of the present invention is to provide a working method of crushing and separating a waste substance of a weather strip and an apparatus therefor, where a waste substance of a weather strip can be crushed and separated suitably and efficiently, and there is no fear of generating secondary environmental pollution, and further special technology and facilities are utilized.

A working method of crushing and separating a waste substance of a weather strip according to the present invention comprises:

step of supplying a waste substance of a weather strip installed on a door, a window frame, a trunk room or the like of a vehicle to a shredder in sequence;

step of leading the waste substance supplied to the shredder into a crushing gap formed between a wall surface of an intermediate wall rocking by the fine adjustment in mm unit and hammers of the shredder, and crushing and separating the waste substance into a crushed waste metallic substance and a crushed waste non-metallic substance utilizing the crushing gap to be finely adjusted in mm unit and striking of the hammers;

step of discharging the crushed waste metallic substance and the crushed waste non-metallic substance out of the shredder through box-shaped spaces having an inclined plane of an inclined upper shredder damper rocking by the fine adjustment in mm unit of the shredder; and step of selecting the crushed waste metallic substance in 2–5 mm unit and the crushed waste non-metallic substance both discharged.

A working apparatus of crushing and separating a waste substance of a weather strip according to the present invention comprises:

conveying means for automatically conveying a waste substance of a weather strip installed on a door, a window frame, a trunk room or the like of a vehicle;

a shredder having a shredder drum with a number of hammers for crushing and separating the waste substance supplied by the conveying means into a crushed waste metallic substance and a crushed waste non-metallic substance; and discharging means for discharging the crushed waste metallic substance in 2–5 mm unit and the crushed waste non-metallic substance treated by the shredder, wherein a crushing chamber and a sending-out passage of the shredder is partitioned into an upper part, an intermediate part and a lower part, and the upper part is partitioned by an inclined upper shredder damper having a number of through holes and rocking by the fine adjustment in mm unit, and the intermediate part is partitioned by an inclined lower shredder damper rocking by the fine adjustment in mm unit, and further the lower part is partitioned by an intermediate wall rocking by the fine adjustment in mm unit, the shredder drum with a number of hammers is installed in the crushing chamber of the shredder, and a gap is formed between a head surface of the hammer of the shredder drum and a wall surface of the intermediate wall.

The present invention is in a working method that a waste substance of a weather strip is crushed and separated into a crushed waste metallic substance and a crushed waste non-metallic substance by the crushing utilizing an intermediate wall and inclined upper and lower shredder dampers rocking by the fine adjustment in mm unit and striking by hammers, and that the crushed waste metallic substance in 2–5 mm unit and the crushed waste non-metallic substance produced by the crushing and separating working are discharged out of the shredder through box-shaped spaces having an inclined plane of the upper shredder damper. Accordingly a waste substance of a flexible weather strip constituted by a thin flexible metal member in a small flat U-like shape having a cut groove and a rubber member covering the metal member can be crushed and separated securely and efficiently, and the crushed waste metallic substance and the crushed waste non-metallic substance can be manufactured in the state that they are valuable as articles of commerce and can be effectively utilized as resources. When the crushed waste metallic substance is supplied to a furnace, for example, the melting speed can be improved and the fuel cost necessary for the melting can be saved. Also this method can contribute to prevention of abuses such as the contamination of the atmosphere and environmental pollution by soot and smoke due to generation of chlorine gas.

Also the present invention has such construction that a crushing chamber and a sending-out passage of a shredder are partitioned into an upper part, an intermediate part and a lower part, and the upper part is partitioned by an inclined upper shredder damper having a number of through holes and rocking by the fine adjustment in mm unit, and the intermediate part is partitioned by an inclined lower shredder damper rocking by the fine adjustment in mm unit, and further the lower part is partitioned by an intermediate wall rocking by the fine adjustment in mm unit. Accordingly the waste substance can be crushed and separated securely and efficiently, and the crushed waste metallic substance in 2–5 mm unit and the crushed waste non-metallic substance can be manufactured in the state that they are valuable as articles of commerce and can be effectively utilized as resources. Also since the crushed waste metallic substance and the crushed waste non-metallic substance can be manufactured efficiently by utilizing the shredder dampers rocking by the fine adjustment in mm unit, the burden to the shredder can be reduced and the facilities and the apparatuses can be made small size. Further since the gap between the hammer and the intermediate wall can be adjusted by the fine adjustment in mm unit, in response to the abraded state of the hammer, the gap between the hammer and the intermediate wall can be simply adjusted, and also the crushed waste metallic substance and the crushed waste non-metallic substance can be manufactured in the state that they are valuable as articles of commerce.

DESCRIPTION OF THE PREFERRED EMBODIMENTS

At first, outline of embodiments shown in FIGS. 1 to 19 will be described.

Figure 1:
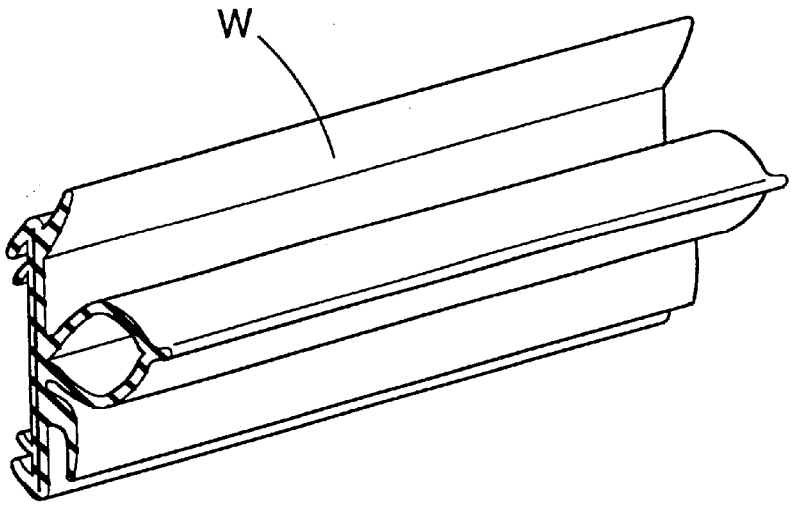
FIG. 1 is a perspective view showing an example of a waste substance of a weather strip.
Figure 2:
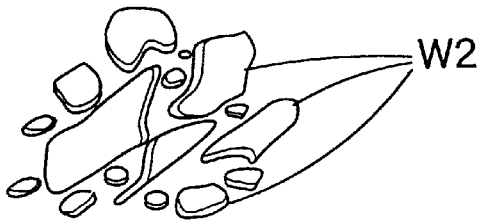
FIG. 2 is a perspective view showing an example of a crushed waste non-metallic substance in FIG. 1.
Figure 3:
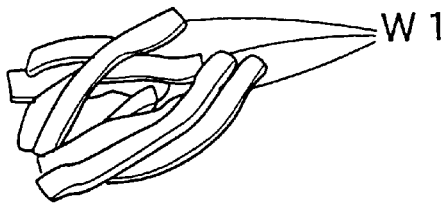
FIG. 3 is a perspective view showing an example of a crushed waste metallic substance in FIG. 1.
Figure 4:
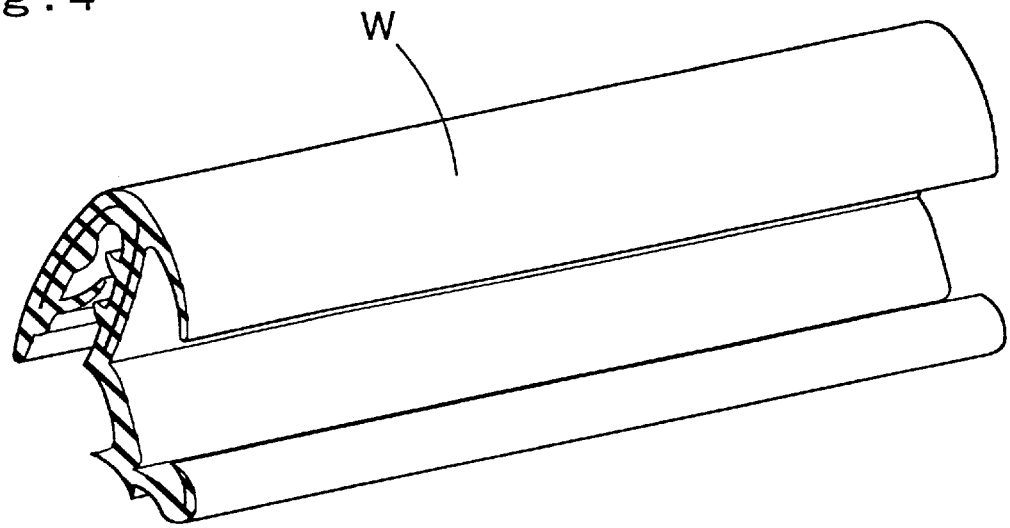
FIG. 4 is a perspective view showing another example of a waste substance of a weather strip.
Figure 5:
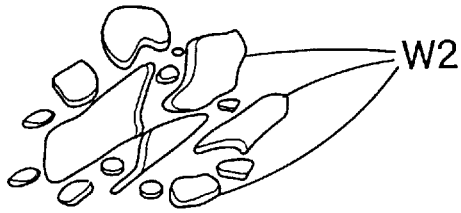
FIG. 5 is a perspective view showing an example of a crushed waste non-metallic substance in FIG. 4.
Figure 6:
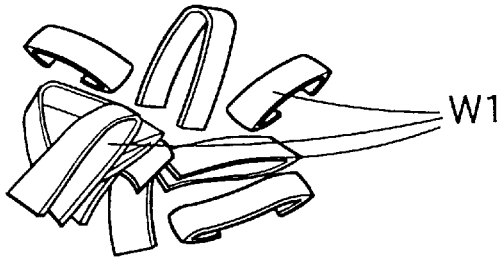
FIG. 6 is a perspective view showing an example of a crushed waste metallic substance in FIG. 4.
Figure 7:
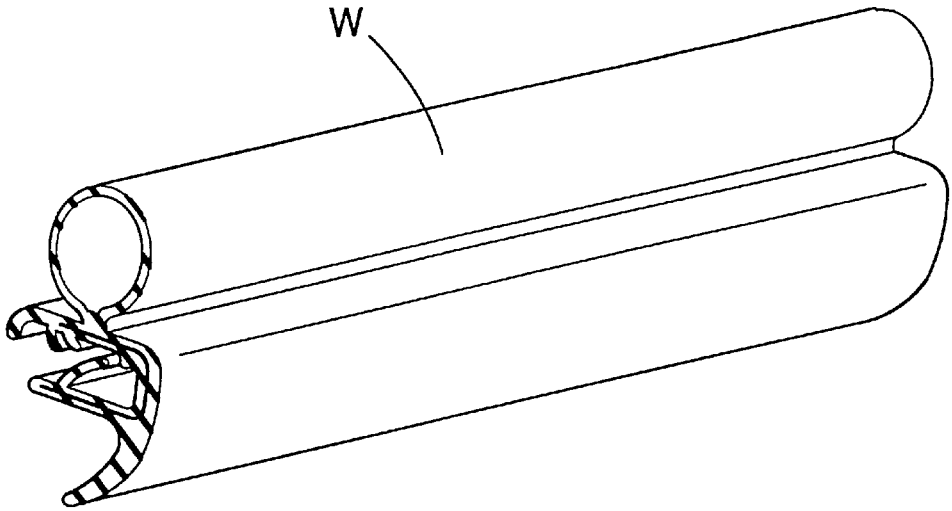
FIG. 7 is a perspective view showing still another example of a waste substance of a weather strip.
Figure 8:
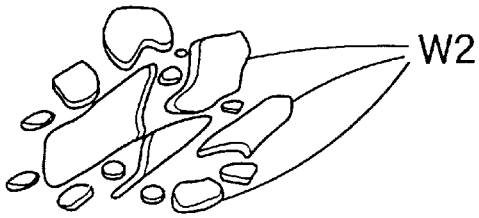
FIG. 8 is a perspective view showing an example of a crushed waste non-metallic substance in FIG. 7.
Figure 9:
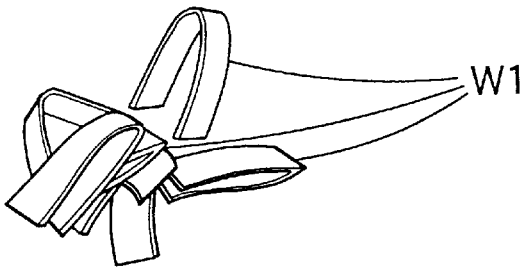
FIG. 9 is a perspective view showing an example of a crushed waste metallic substance in FIG. 7.
Figure 10:
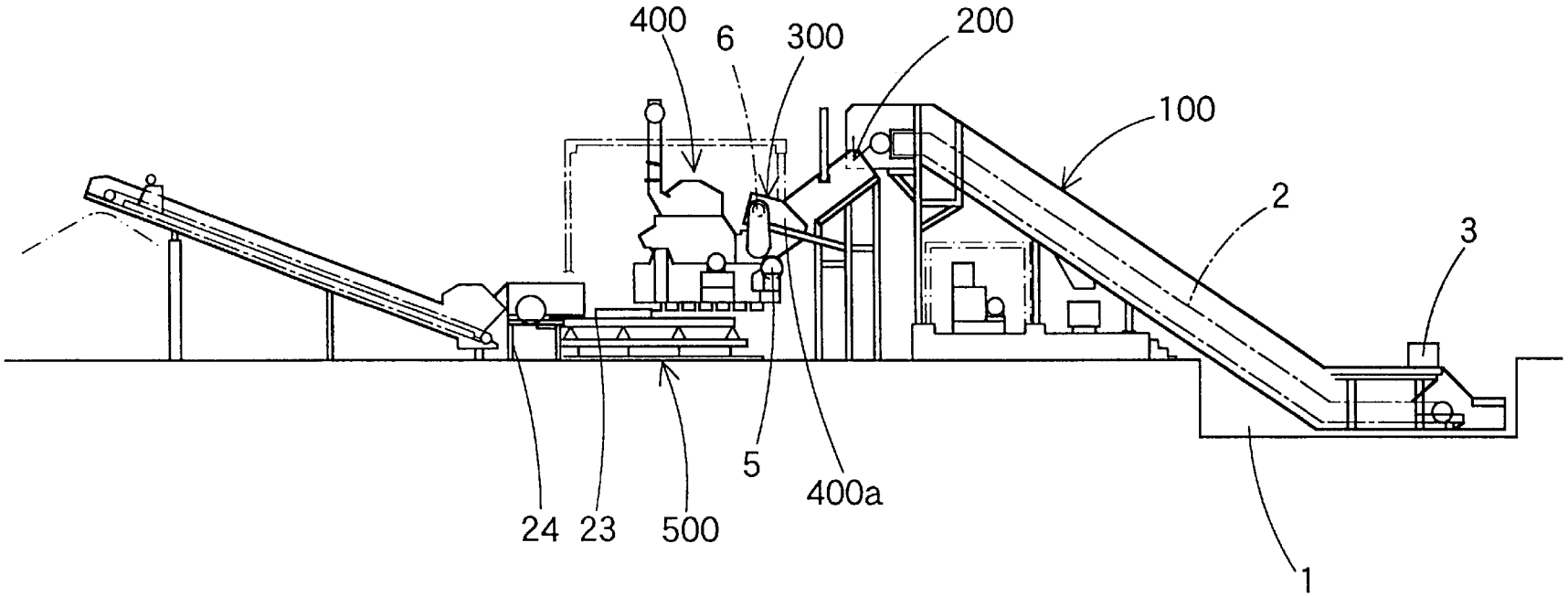
FIG. 10 is a side view showing whole configuration of the invention.
Figure 11:
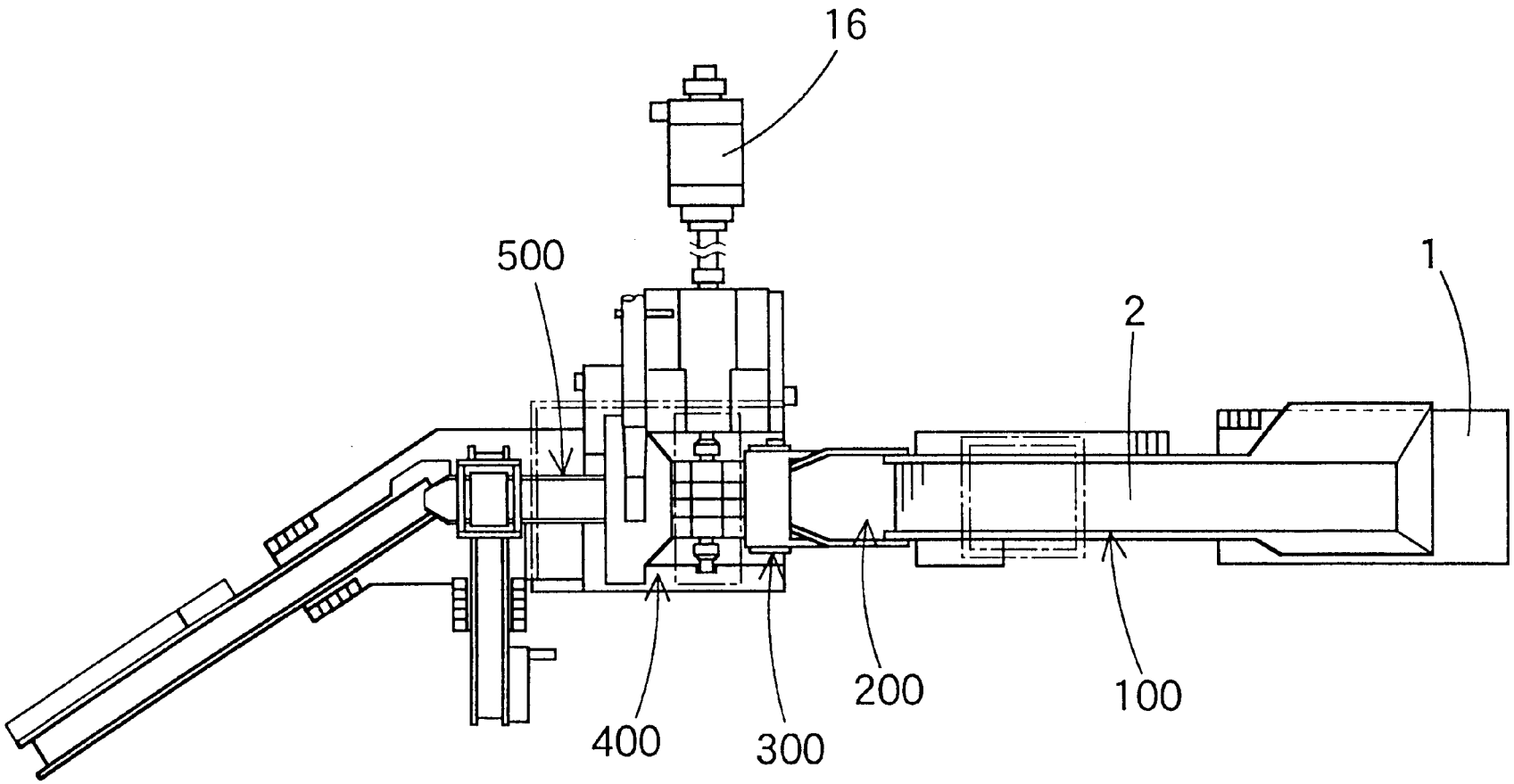
FIG. 11 is a plane view showing whole configuration of the invention.

In FIGS. 10 and 11, a waste substance W is sent to a supply device 300 by conveying means (conveyor) 100.

The waste substance W sent to the supply device 300 is regularly supplied in every fixed quantity to a shredder 400.

Figure 13:
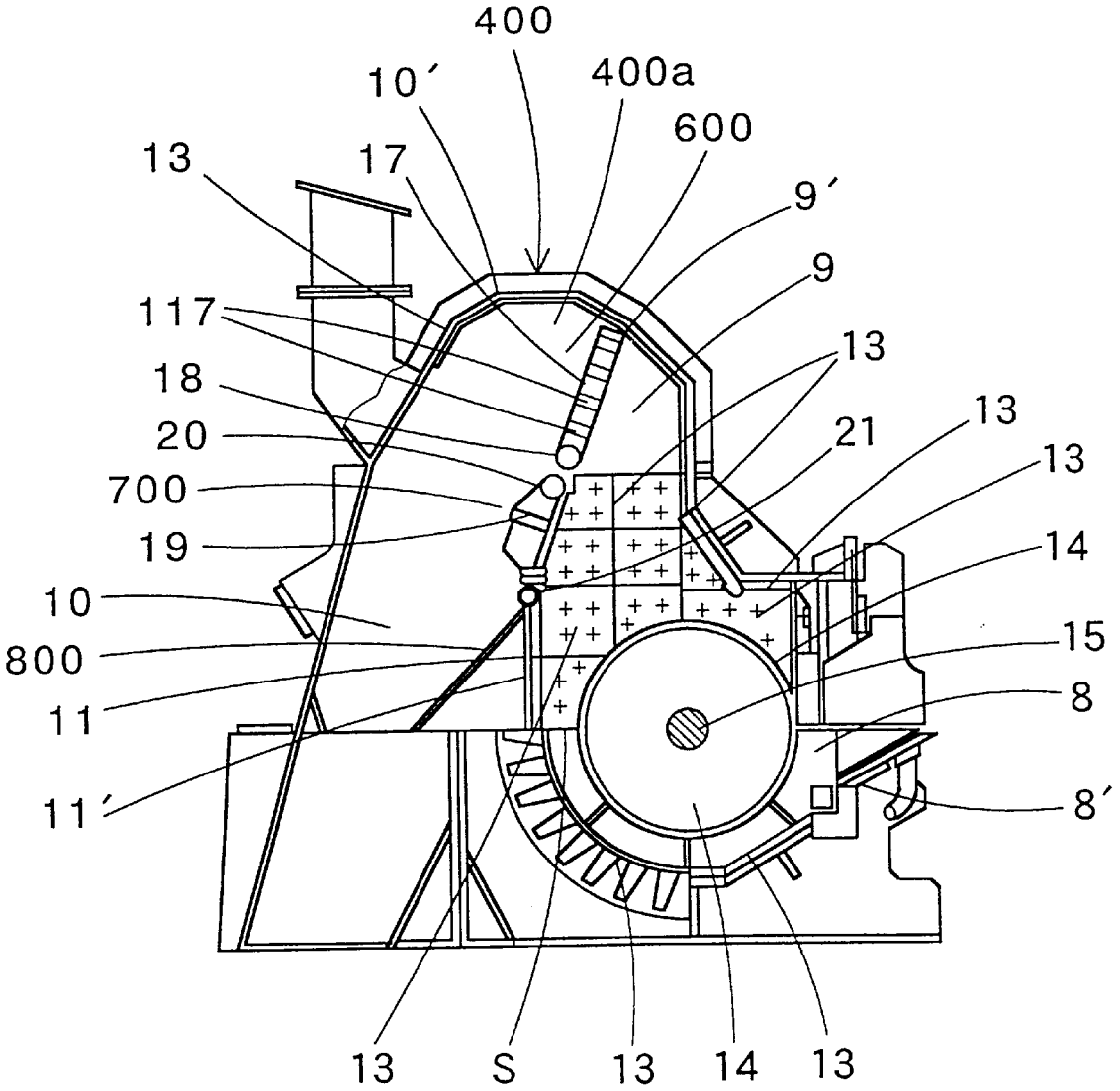
FIG. 13 is an enlarged sectional view of a shredder.

After the waste substance W supplied to the shredder 400 is scooped up by a shredder drum 14 (FIGS. 13, 14 and 15) rotating at high speed and hammers 14a (FIGS. 14 and 15), it is crushed and separated first by an upper part 600 (FIG. 13) and an intermediate part 700 (FIG. 13). That is, the waste substance W is bumped against an upper shredder damper 17 (FIGS. 13, 16 and 19) and an inclined lower shredder damper 19 (FIGS. 13, 17, 18 and 19) both being rockable by the fine adjustment in mm unit.

Subsequently the crushing and separating working is performed in the lower part 800 (FIG. 13). That is, the waste substance W is compressed by a spacing S formed between a wall surface 11' of an intermediate wall 11 (a wall surface on which liners 13 are mounted) and hammers 14*a* of the shredder drum 14 shown in FIG. 13 suitably utilizing the fine adjustment in mm unit. Depending on the spacing dimension adjustable finely in mm unit, the compressed dimension of the crushed waste metallic substance W1 and the crushed waste non-metallic substance W2 being fractionalized is determined.

As above described, by the operation that the hammers 14*a* of the shredder drum 14 are brought close to the inclined upper and lower shredder dampers 17 and 19 rocking by the fine adjustment in mm unit and to the wall surface 11' of the intermediate wall 11 rocking by the fine adjustment in mm unit (the adjustment of the spacing by the fine adjustment), the effective crushing and separating working can be intended while the dimension adjustment of the crushed waste metallic substance W1 and the like or the individual adjustments such as the crushing time adjustment are intended. The crushed waste metallic substance W1 and the like becoming the prescribed dimension mainly pass through box-shaped spaces 117 (FIGS. 13, 16 and 19) having an inclined plane of the upper shredder damper 17 of the upper part 600 and are led to a sending-out passage 10 (FIG. 13) of the shredder 400, and then are divided into the crushed waste metallic substance W1 and the crushed waste non-metallic substance W2, for example, by human means and are housed in respective cases.

Regarding the dimensions of the crushed waste metallic substance W1 and the like, the crushed waste metallic substance W1 has the dimension of about 2 mm to about 5 mm and the crushed waste non-metallic substance W2 is a small piece. Among them, the crushed waste metallic substance W1 of about 2 mm to about 5 mm is not subjected to the adhering of the crushed waste non-metallic substance W2 and is beautiful and can be reused immediately. As above described, the positions of the upper and lower shredder dampers 17 and 19 and the wall surface 11' of the intermediate wall 11 rocking by the fine adjustment in mm unit directly influence the relief of the impact to the upper and lower shredder dampers 17 and 19 and the wall surface 11' of the intermediate wall 11, and the efficient separation between the crushed waste metallic substance W1 and the crushed waste non-metallic substance W2, and the values of the dimension of the crushed waste metallic substance W1 and the like.

After the crushed waste metallic substance W1 and the like which can not pass through the box-shaped holes 117 of the upper shredder damper 17 of the upper part 600 pass through the lower shredder damper 19 of the intermediate part 700, they fall from the spacing between the wall surface 11l of the intermediate wall 11 of the lower part 800 and the outer circumferential surface of the shredder drum 14 toward the bottom surface of the crushing chamber 9 (FIG. 13) of the shredder 400. Subsequently the crushed waste metallic substance W1 and the like are scooped up again by the shredder drum 14 and the hammers 14*a*, and the crushing and separating working is performed by the treatment (operation and procedure) substantially similar to that as above described. Consequently the introduced waste substance W is crushed and separated into the crushed waste metallic substance W1 and the like, and the above-mentioned operation and procedure are repeated until the crushed waste metallic substance W1 and the like of the prescribed dimension are obtained by the crushing and separating working.

Next, the embodiment will be described more specifically.

The working method and apparatus of crushing and separating the waste substance according to the present invention, as shown in the whole configuration in FIGS. 10 and 11, has a cutting machine for cutting the waste substance W (provided if necessary), conveying means (conveyor) 100 supplying the waste substance W to a shredder 400, a chute 200 in slant form connected to the conveyor 100, a supply device 300 provided in riding state at lower side of the chute 200, a shredder 400 connected to the supply device 300, and a vibration type separating device 500 positioned under a sending-out passage 10 (FIG. 13) of the shredder 400, all constituting the main components.

The conveyor 100 is constituted by a conveying member 2 of a number of steel belts, rollers, belts, and is rotated by a drive device 3 (FIG. 10). The front end of the conveying member 2 is provided at a pit 1 (FIGS. 10 and 11), and the chute 200 is provided at the rear end of the conveyor 100. The waste substance W is supplied to the chute 200 by the conveyor 100.

The front end of the chute 200 is connected to the conveyor 100, and its rear end is connected to the supply device 300 as described later respectively. The waste substance W is fed to the supply device 300 by the chute 200.

Figure 12:
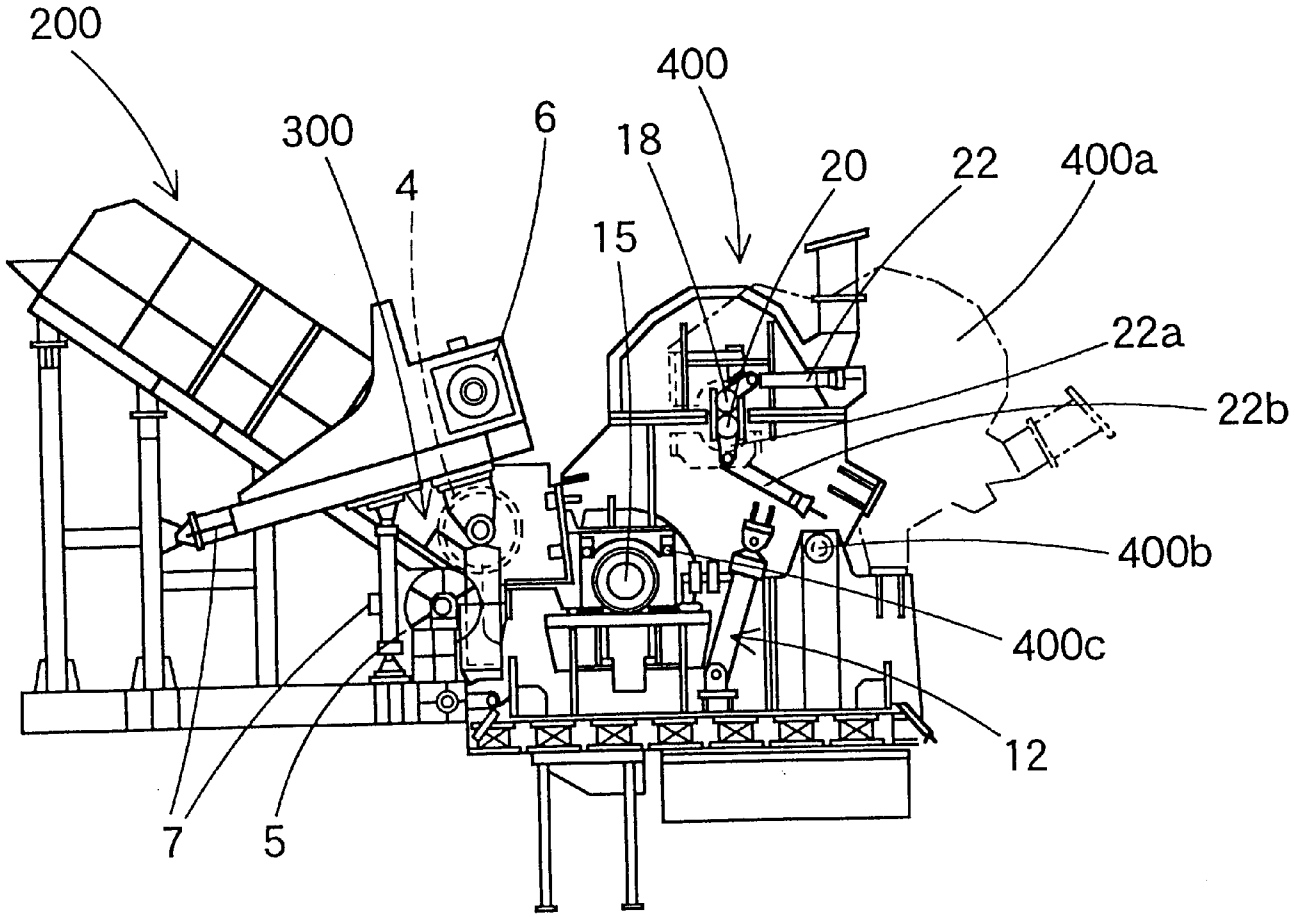
FIG. 12 is an enlarged side view showing mutual relation of a shredder, a supply device and a hammer shaft mounting/detaching device.

The supply device 300 as shown in FIG. 12, is constituted by a pair of supply rolls 4 and 5 provided at the downward slant portion of the chute 200, drive means 6 such as a motor 16 (FIG. 11) giving the rotation to the supply roll 4 at the drive side, and several cylinders 7 moving the supply device 300 upward and downward. The waste substance W is supplied in each fixed quantity to the shredder 400 in next step by the rotation of the supply rolls 4 and 5.

The shredder 400 as shown in FIG. 13, is constituted by an inlet port 8 opened at the side of the supply rolls 4 and 5, a crushing chamber 9 in substantially square shape in the front view, a sending-out passage 10 leading to the crushing chamber 9, an upper shredder damper 17 partitioning between the crushing chamber 9 and the upper part 600 of the sending-out passage 10 and having a number of holes 117 through which the crushed waste metallic substances W1 can pass and rocking by the fine adjustment in mm unit, a lower shredder damper 19 partitioning between the crushing chamber 9 and the intermediate part 700 of the sending-out passage 10 and having a recess 119 and rocking by the fine adjustment in mm unit, and an intermediate wall 11 partitioning between the crushing chamber 9 and the lower part 800 of the sending-out passage 10 and functioning as a receiving blade and rocking by the fine adjustment in mm unit. Here, the rocking by the fine adjustment in mm unit is rocking of the upper shredder damper 17 of the upper part 600 and the lower shredder damper 19 of the intermediate part 700 as well as the intermediate wall 11 of the lower part 800 respectively at each free end side (reverse side to the pivotally attached side).

An upper casing 400*a* constituting the shredder 400 is constructed to be moved upward by action of a cylinder 12 so that about ½ of the shredder 400 can be opened freely. In the figures, numeral 400*b* designates a pivotally attaching part of the upper casing 400*a*, and numeral 400*c* designates fixing means. Individual wall surfaces 8', 9' and 10' being a part of the inlet port 8, the crushing chamber 9 and the sending-out passage 10 are constituted by a number of liners 13. When the liner 13 is abraded, damaged or broken, the opening of about ½ of the shredder 400 is utilized thereby the liner 13 to be replaced due to the abrasion or the like can be replaced simply and securely.

Figure 14:
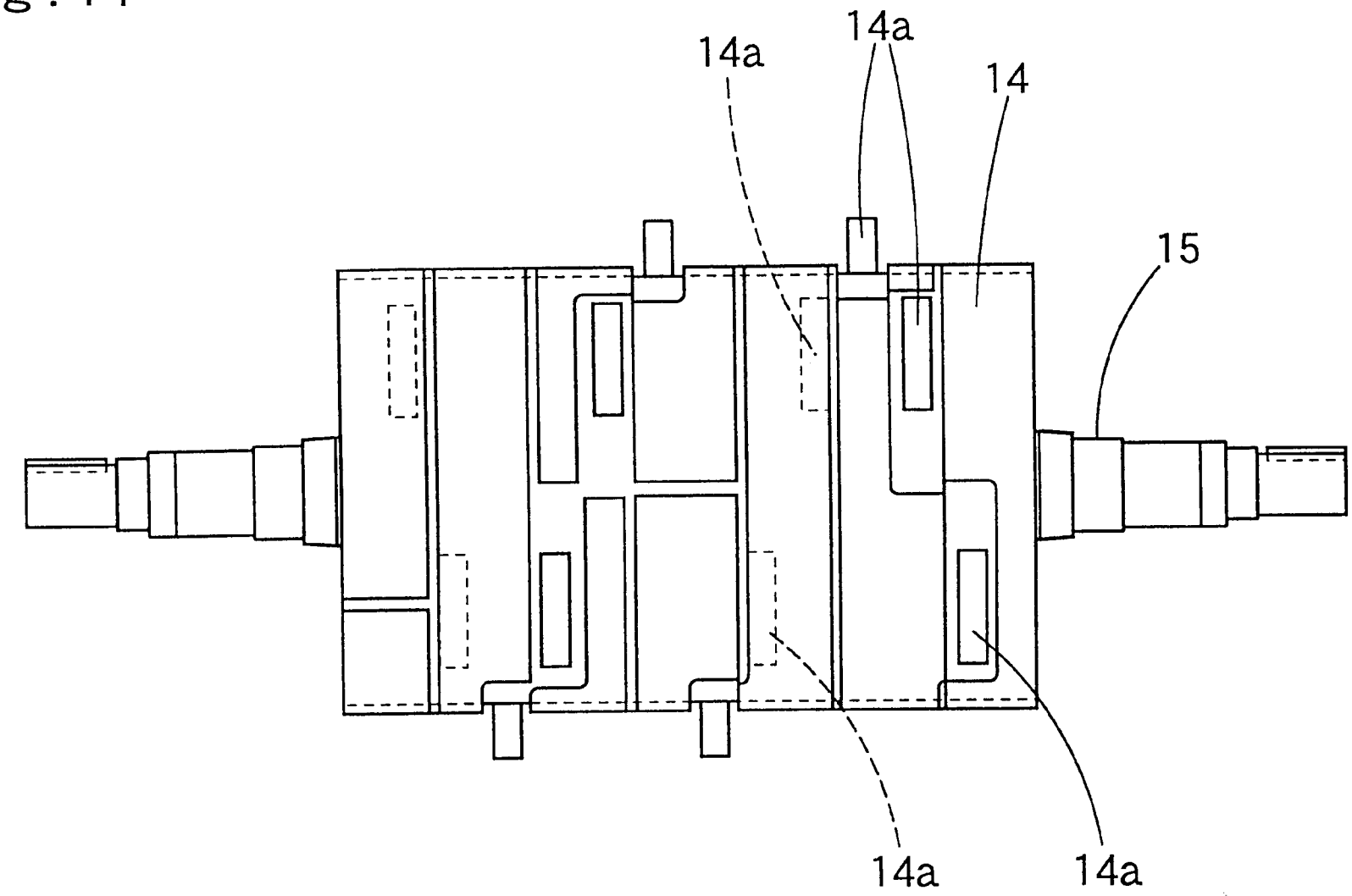
FIG. 14 is an enlarged plane view showing an example of a hammer.
Figure 15:
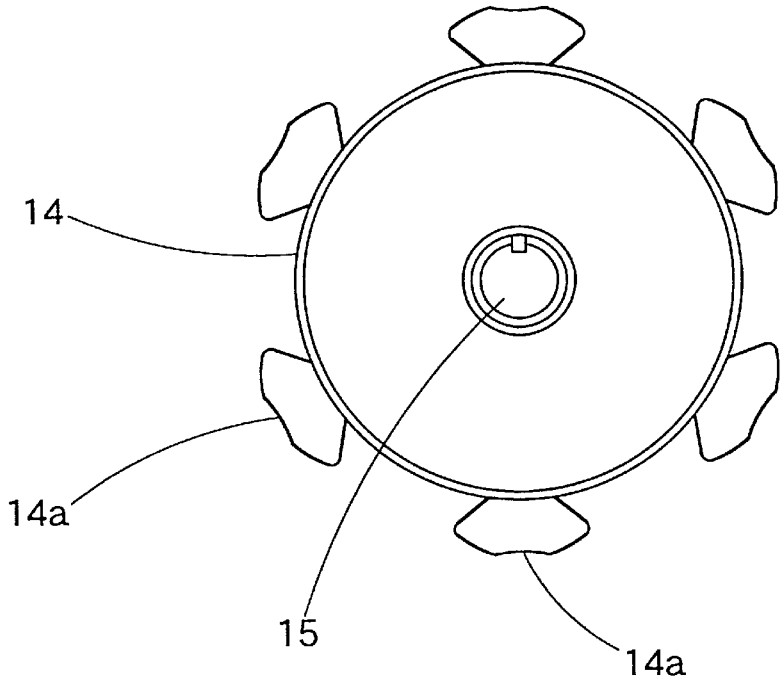
FIG. 15 is an enlarged side view showing an example of a hammer.
Figure 16:
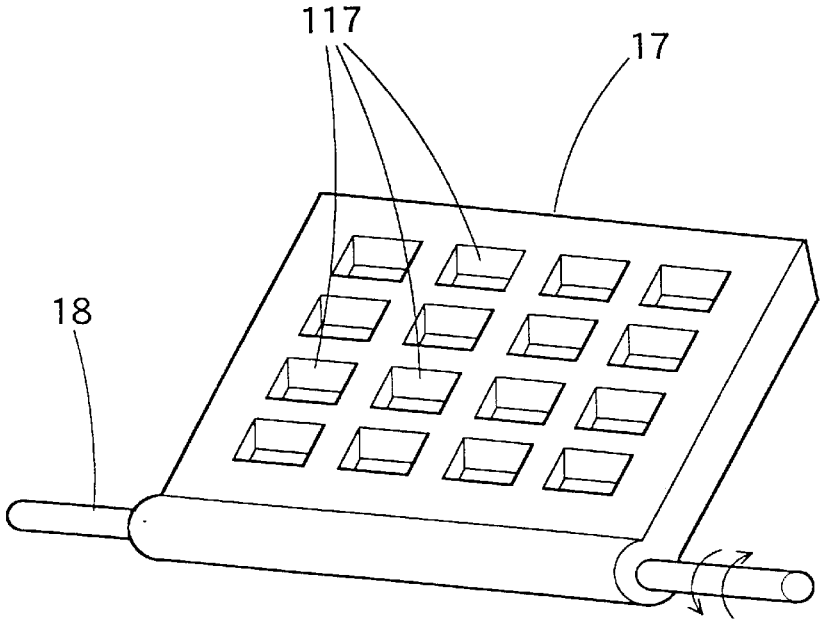
FIG. 16 is an enlarged perspective view showing an upper shredder damper.

A shredder drum 14 as shown in FIG. 14 is supported in the lower side of the crushing chamber 9 so that a slight gap exists between it and the lower side of the intermediate wall 11. A shaft 15 of the shredder drum 14 is extended in the lateral direction of the shredder 400, and is connected to a motor 16 via transmission means (not shown). The shaft 15 of the shredder drum 14 is rotated via drive of the motor 16 counterclockwise for example. By the rotation of the shaft 15, the shredder drum 14 is rotated counterclockwise, and strikes the waste substance W introduced from the inlet port 8 onto the ceiling or the side surface of the crushing chamber 9 and the wall surfaces 9' and 11' of the intermediate wall 11 or the like and also strikes it onto the upper and lower shredder dampers 17 and 19 installed rockable on the upper side of the intermediate wall 11. The waste substance W is crushed by the striking operation as above described. Here, according to the changing of the rocking position of the upper and lower shredder dampers 17 and 19 by the fine adjustment in mm unit, the amount of the crushing dimension is determined and the crushed waste metallic substance W1 and the crushed waste non-metallic substance W2 are separated from each other.

The shredder drum 14 has a number of hammers 14*a* projecting in suitable positions. The hammers 14*a* strike and crush the waste substance W. The waste substance W is crushed by the striking of the hammers 14*a* and by the striking between the hammers 14*a* and the wall surfaces 9' and 11' or the upper shredder damper 17 to some degree, and is further compressed by the spacing S (FIG. 13) formed between the top end of the wall surface 11' of the intermediate wall 11 (the wall surface 11' of the intermediate wall 11) and the head surface of the hammer 14*a* of the shredder drum 14 by the fine adjustment in mm unit. According to the compression, the crushing and separating working of the crushed waste metallic substance W1 and the like is further intended and the crushed dimension of the crushed waste metallic substance W1 and the like is determined. That is, the wall surface 11' of the intermediate wall 11 functions as the receiving blade in relation to the hammers 14*a* and performs the compressing work. Also the upper shredder damper 17 has holes 117 and the crushed waste metallic substance W1 and the like of the prescribed dimension passing through the holes 117 are subsequently sent out to the sending-out passage 10.

Figure 17:
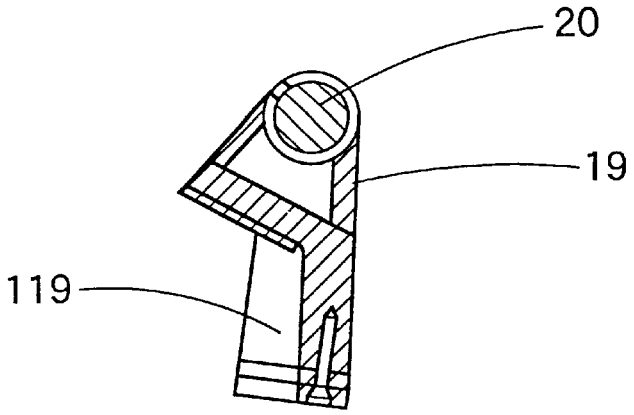
FIG. 17 is an enlarged sectional view showing a lower shredder damper.
Figure 18:
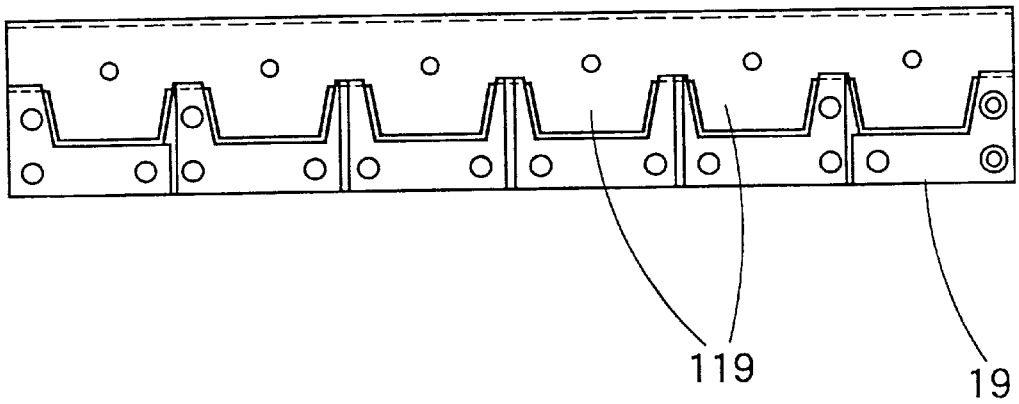
FIG. 18 is an enlarged rear view showing a lower shredder damper.
Figure 19:
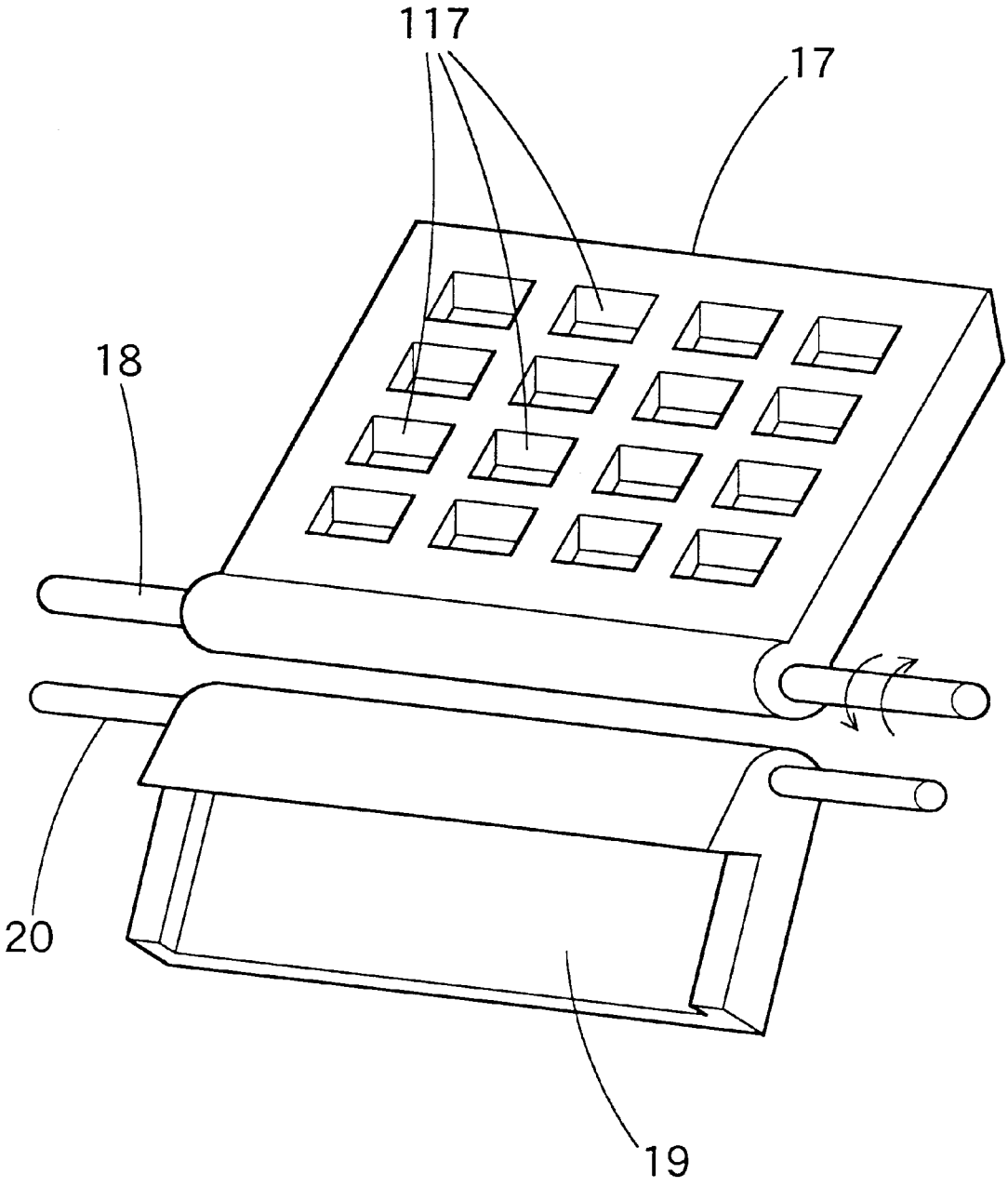
FIG. 19 is an enlarged perspective view showing upper and lower shredder dampers.

The upper shredder damper 17 adopting the above-mentioned constitution partitions between the crushing chamber 9 and the upper part 600 of the sending-out passage 10, and has structure of rocking via cylinder 22 (FIG. 12) attached to a shaft 18 (FIGS. 12, 13, 16 and 19) about the shaft 18 by the fine adjustment in mm unit. Also the lower shredder damper 19 partitions between the crushing chamber 9 and the intermediate part 700 of the sending-out passage 10, and has structure of rocking via cylinder 22a (FIG. 12) attached to a shaft 20 (FIGS. 12, 13, 17 and 19) about the shaft 20 by the fine adjustment in mm unit. Further the wall surface 11' of the intermediate wall 11 partitions between the crushing chamber 9 and the lower part 800 of the sending-out passage 10, and has structure of rocking via cylinder 22*b* (FIG. 12) attached to a shaft 21 (FIG. 13) about the shaft 21 by the fine adjustment in mm unit. In addition, the lower shredder 19 has a recess 119 (FIGS. 17 and 18). When the lower shredder damper 19 rocks beyond the wall thickness by the fine adjustment in mm unit, the recess 119 intermittently forms a cavity portion (not shown) in the intermediate wall 11 and the crushed waste metallic substances W1 are sent out from the cavity portion.

As a method of rocking the intermediate wall 11 and the upper and lower shredder dampers 17 and 19 by the fine adjustment in mm unit, there are a method of rocking by mutual interlocking, a method of rocking individually and the like. In selecting these methods, for example, the quality, the quantity and the crushing condition of the waste substance W or the capacity, the state of the environment, the machine, the facilities or the like must be considered. This point is considered and the optimum method is adopted.

The upper and lower shredder dampers 17 and 19 are installed in slant state within the shredder 400 as shown in FIG. 13. Also the upper and lower shredder dampers 17 and 19 have structure which is useful and practical in order to produce the crushed waste metallic substance W1 and the crushed non-metallic substance W2 in the prescribed dimension. The upper and lower shredder dampers 17 and 19 and the intermediate wall 11 and the like are controlled automatically or manually, for example, by computer control, manual control or the like. In the case of the automatic control, the open degree is detected by a sensor (not shown) and the control is performed considering the dimension, the separation degree and the like of the crushed waste metallic substance W1 and the crushed waste non-metallic substance W2 to be produced.

A vibration type separating device 500 is arranged at the lower side of the sending-out passage 10 of the shredder 400. The vibration type separating device 500 as shown in FIG. 10, is constituted by a drive unit (not shown), a vibration plate 23 with an uneven portion, and a vibration-proof spring 24 supporting the vibration plate 23, so that the crushed waste metallic substance W1 and the crushed waste non-metallic substance W2 supplied on the vibration plate 23 are separated by the vibration.

As above described, the present invention is in a working method that a waste substance of a weather strip is crushed and separated into a crushed waste metallic substance and a crushed waste non-metallic substance by the crushing utilizing an intermediate wall and upper and lower shredder dampers rocking by the fine adjustment in mm unit and striking by hammers and that the crushed waste metallic substance and the crushed waste non-metallic substance produced by the crushing and separating working are discharged out of the shredder through box-shaped spaces of the upper shredder damper. Accordingly a waste substance of a flexible weather strip constituted by a thin flexible metal member in a small flat U-like shape having a cut groove and a rubber member covering the metal member can be crushed and separated securely and efficiently, and the crushed waste metallic substance and the crushed waste non-metallic substance can be manufactured in the state that they are valuable as articles of commerce and can be effectively utilized as resources. When the crushed waste metallic substance is supplied to a furnace, for example, the melting speed can be improved and the fuel cost necessary for the melting can be saved. Also this method can contribute to prevention of abuses such as environmental pollution by soot and smoke and the contamination of the atmosphere.

Also the present invention has such construction that a crushing chamber and a sending-out passage of a shredder are partitioned into an upper part, an intermediate part and a lower part, and the upper part is partitioned by an upper shredder damper having a number of through holes and rocking by the fine adjustment in mm unit, and the intermediate part is partitioned by a lower shredder damper rocking by the fine adjustment in mm unit, and further the lower part is partitioned by an intermediate wall rocking by the fine adjustment in mm unit. Accordingly the waste substance can be crushed and separated securely and efficiently, and the crushed waste metallic substance and the crushed waste non-metallic substance can be manufactured in the state that they are valuable as articles of commerce and can be effectively utilized as resources. Also since the crushed waste metallic substance and the crushed waste non-metallic substance can be manufactured efficiently by utilizing the shredder dampers rocking by the fine adjustment in mm unit, the burden to the shredder can be reduced and the facilities and the apparatuses can be made small size. Further since the gap between the hammer and the intermediate wall can be adjusted by the fine adjustment in mm unit, in response to the abraded state of the hammer, the gap between the hammer and the intermediate wall can be simply adjusted, and also the crushed waste metallic substance and the crushed waste non-metallic substance can be manufactured in the state that they are valuable as articles of commerce.

What is claimed is:

1. A working method of crushing and separating a waste substance of a weather strip useful for installation on a vehicle, said weather strip being formed of a flexible metal member having a cut groove and a rubber member covering the metal member, said working method comprising:

a step of supplying said waste substance to a shredder having an inlet side and an outlet side;

a step of leading the waste substance supplied to the shredder into a crushing gap formed between a wall surface of an intermediate wall and hammers of the shredder, and crushing and separating the waste substance into a crushed waste metallic substance and a crushed waste rubber substance utilizing the crushing gap and striking of the hammers, wherein the intermediate wall is pivoted about a first shaft to adjust the distance between said wall surface and said hammers;

a step of discharging the crushed waste metallic substance and the crushed waste rubber substance out of the shredder from the outlet side through box-shaped holes provided in an inclined upper shredder damper which is pivoted about a second shaft to adjust the slope of the inclined upper shredder damper, and the longitudinal axes of the first shaft and the second shaft are displaced from each other in a direction extending from the inlet side to the outlet side of the shredder; and a step of separating the discharged crushed waste metallic substance having a 2–5 mm particle size and the discharged crushed waste rubber substance.

2. A working apparatus for crushing and separating a waste substance of a weather strip formed of a metallic substance and non-metallic substance and being useful for installation on a vehicle, said working apparatus comprising:

conveying means for automatically conveying the waste substance;

a shredder having an inlet side and an outlet side, and a shredder drum with a number of hammers for crushing and separating the waste substance supplied to the inlet side by the conveying means into a crushed waste metallic substance and a crushed waste non-metallic substance; and discharging means for discharging from the outlet side the crushed waste metallic substance having a 2–5 mm particle size and the crushed waste non-metallic substance produced by the crushing and separating in the shredder, wherein the shredder has a crushing chamber and a sending-out passage leading to the crushing chamber, wherein the sending out passage is partitioned into an upper part, an intermediate part and a lower part, and the upper part is partitioned by an inclined upper shredder damper having a number of through holes and being pivotal about a first shaft, and the intermediate part is partitioned by an inclined lower shredder damper pivotal about a second shaft, and the lower part is partitioned by an intermediate wall pivotal about a third shaft, the shredder drum with a number of hammers is installed in the crushing chamber of the shredder, a crushing gap is formed between the hammers of the shredder drum and a wall surface of the intermediate wall, and the longitudinal axes of the first shaft and the second shaft are displaced from the longitudinal axis of the third shaft in a direction extending from the inlet side to the outlet side.

* * * * *